US008618400B2

(12) United States Patent
Murphy et al.

(10) Patent No.: US 8,618,400 B2
(45) Date of Patent: Dec. 31, 2013

(54) ALTERNATIVE ELECTRONIC MUSICAL INSTRUMENT CONTROLLER BASED ON A CHAIR PLATFORM

(76) Inventors: Cary Murphy, Hickory, NC (US); Robert Murphy, San Francisco, CA (US)

( * ) Notice: Subject to any disclaimer, the term of this patent is extended or adjusted under 35 U.S.C. 154(b) by 553 days.

(21) Appl. No.: 12/468,220

(22) Filed: May 19, 2009

(65) Prior Publication Data

US 2009/0288548 A1 Nov. 26, 2009

(51) Int. Cl.
*G10H 1/00* (2006.01)

(52) U.S. Cl.
USPC ..... 84/600; 84/615; 84/645; 84/653

(58) Field of Classification Search
None
See application file for complete search history.

(56) References Cited

U.S. PATENT DOCUMENTS

| | | | | | |
|---|---|---|---|---|---|
| 1,527,754 | A * | 2/1925 | Simon | 601/24 |
| 2,669,784 | A * | 2/1954 | Lewis, Jr | 33/275 R |
| 5,437,453 | A * | 8/1995 | Hineman | 463/38 |
| 6,042,555 | A * | 3/2000 | Kramer et al. | 600/595 |
| 6,105,706 | A * | 8/2000 | Cooper | 180/282 |
| 6,234,446 | B1 * | 5/2001 | Patterson | 248/694 |
| 7,504,577 | B2 * | 3/2009 | Riopelle | 84/723 |
| 8,113,517 | B2 * | 2/2012 | Canterbury et al. | 273/148 B |
| 2003/0030625 | A1 * | 2/2003 | Kauk et al. | 345/169 |
| 2003/0110926 | A1 * | 6/2003 | Sitrick et al. | 84/477 R |
| 2003/0110929 | A1 * | 6/2003 | Riopelle | 84/615 |
| 2004/0046736 | A1 * | 3/2004 | Pryor et al. | 345/156 |
| 2005/0241466 | A1 * | 11/2005 | Riopelle | 84/725 |
| 2006/0087097 | A1 * | 4/2006 | Kramer et al. | 280/304.1 |
| 2008/0054561 | A1 * | 3/2008 | Canterbury et al. | 273/148 B |
| 2008/0111408 | A1 * | 5/2008 | Duran et al. | 297/217.4 |
| 2008/0122786 | A1 * | 5/2008 | Pryor et al. | 345/156 |
| 2009/0221369 | A1 * | 9/2009 | Riopelle | 463/35 |
| 2011/0086747 | A1 * | 4/2011 | Broderick | 482/142 |
| 2012/0115589 | A1 * | 5/2012 | Canterbury et al. | 463/25 |
| 2012/0223555 | A1 * | 9/2012 | Brown, Jr. | 297/217.4 |

* cited by examiner

*Primary Examiner* — Marlon Fletcher

(57) ABSTRACT

An electronic musical instrument controller is constructed by fixing sensors and transducers to sections of a chair, allowing a user to map motion of body, arms, head, hands, fingers, and feet to parameters of a musical instrument such as a hardware or software electronic music synthesizer. The mapping may take place over MIDI, control voltage, computer connection, or other means of interfacing.

4 Claims, 2 Drawing Sheets

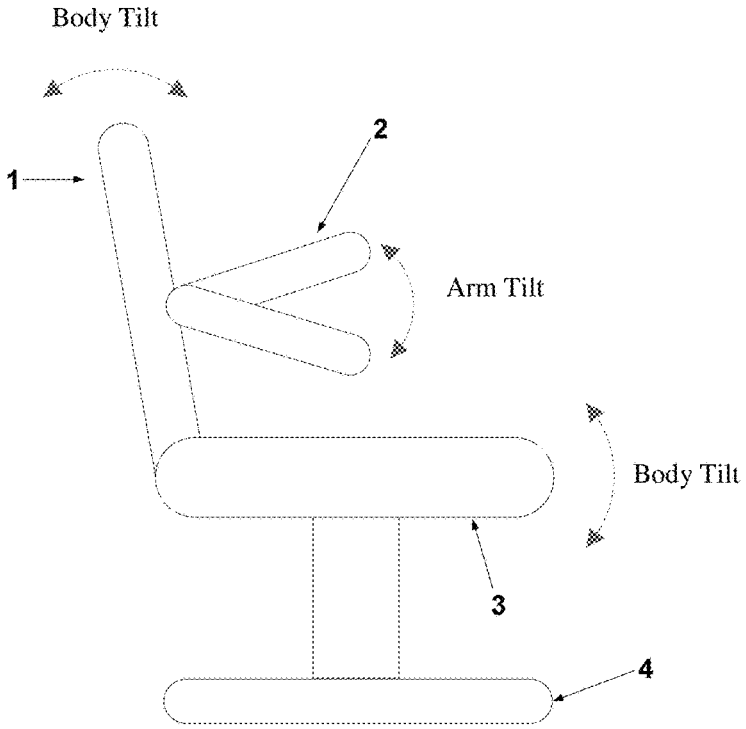
Figure 1 Side View
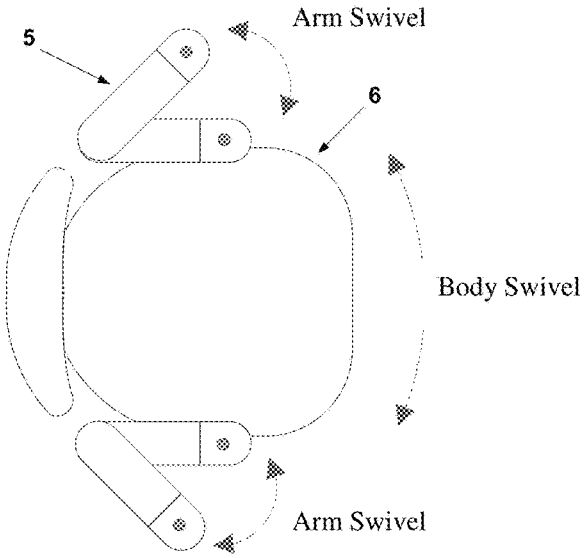
Figure 2 Top View

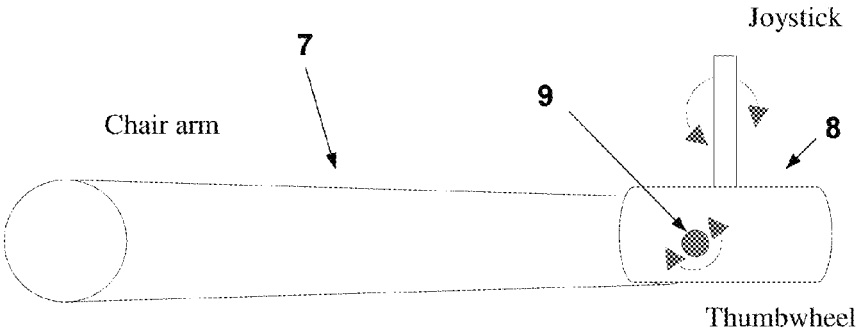
Figure 3 Chair arm showing joystick and thumbwheel

ALTERNATIVE ELECTRONIC MUSICAL INSTRUMENT CONTROLLER BASED ON A CHAIR PLATFORM

RELATED APPLICATIONS

This application claims priority under U.S.C. 119 Provisional Application 61/054,665, filed on 20 May 2008.

FIELD OF INVENTION

This invention describes a device for the control of electronic musical instruments such as, but not limited to, MIDI (Musical Instrument Digital Interface) control or analog control voltage. Since the early 1960's electronic musical instruments have been controlled in forms familiar to conventional acoustic or electro-acoustic instruments such as an organ keyboard. This is a self limiting implementation that hinders use of electronic instruments, somewhat precluding use in microtonal and atonal music. Additionally, the keyboard paradigm limits electronic music exploration to those skilled in keyboard performance, music theory, or more broadly those with the motor skills required to operate a keyboard.

This invention describes a system of total immersion technology, in which the musician is comfortably seated, and uses natural body motion to control aspects such as pitch and timbre. Freed from the requirements of keyboarding and attention to such traditional musical constraints as pitch and keys, the performer is able to become more intuitively in touch with the music and performance. Additionally those who, due to such constraints as medical conditions, are unable to physically perform on a traditional keyboard will be able to use this performance device. It is the intention of the inventors to develop this for use with physically impaired potential musicians.

BACKGROUND OF INVENTION

Include Reference to Each Prior Arts

Electronic musical instruments have been developed for the realization, performance and recording of music using electronic systems. One family of these instruments, the electronic music synthesizer, was developed to create sound electronically, rather than reproduce existing natural sounds. During the 1960s, electronic synthesizers were developed, and used as signal sources and modifiers in tape studios, and as instruments in their own right. Eventually, the term "synthesizer" grew to include a broader definition of instrument, including those that create the sound either electronically or algorithmically in software, as well as those that play and modify a pre-recorded sound—so called "samplers" and "ROMplers". Over time, synthesizers became packaged with organ style keyboards, and became the domain of keyboard players. Because of this shift to the keyboard paradigm, there are two groups of people who are precluded from musical expression—those who are not trained, and those who lack the fine motor skills. The intended beneficiaries of this invention include those two groups.

PRIOR ART

1) A MIDI controller built into a sofa—only detects weight shift. No patent application. See http://musicthing.blogspot.com/2005/07/sofa-as-midi-controller.html 2) U.S. Pat. No. 5,189,240: Breath controller for musical instruments This is a non-keyboard controller that allows synthesizer parameters to be controlled by the flow of breath from the mouth.

3) U.S. Pat. No. 6,018,118: System and method for controlling a music synthesizer, Smith et. Al controls an electronic music synthesizer by mapping transducers affixed to the body or clothing of a free-standing performance artist to parameters in an electronic musical instrument.

4) "Gesture Chair" as described in "Dual-Use Technologies for Electronic Music Controllers: A Personal Perspective", Joseph A. Paradiso, Proceedings of the 2003 Conference on New Interfaces for Musical Expression (NIME-03), Montreal, Canada NIME03-228

This gesture chair tracks the movement of the performer's arms in free space as a means to control an electronic musical instrument.

No other prior art found.

SUMMARY OF THE INVENTION

Include Drawing Descriptions

In its purest form, this invention is a musical instrument controller constructed on the platform of a chair. This is done with the intention of supporting and relaxing the performer while presenting numerous opportunities for control. In the present invention, multiple degrees of motion are supported, which in turn control various aspects of electronic music production.

It is one object of the present invention to provide an arrangement for detecting the motion of human body, or portions thereof, and convert that motion, position, velocity, or acceleration to a signal such as an electrical or fiber optic signal for the control of parameters of an electronic music synthesizer.

Preferably the present invention is built into a chair.

Preferably the arms are independently anchored at one end and swivel.

Preferably the arms are independently able to tilt up and down.

Preferably individual transducers are mounted at the far end of the chair arms, utilizing X-Y or X-Y-Z joysticks and thumbwheels.

Preferably the chair body swivels left and right.

Preferably the chair tilts forward and backwards.

Preferably all above listed motions are converted to a control signal for modifying one or more characteristics of sound or music.

Preferably foot pedals are placed in front of the chair for creation of additional control signals.

Preferably transducers detect motion of the head of the person using the present invention.

Preferably all motions of the individual portions are sensed and transmitted to an electronic music synthesizer.

Preferably the electronic music synthesizer is a so-called hardware synthesizer, or synthesizer software operating on a computer device.

Preferably the sensors detect position, motion, velocity, or acceleration of the components.

The control actuators available to the user include, but are not limited to:

Left and right arm swivel
Left and right arm tilt
Left and right joystick (x-y linear controller)
Left and right thumb wheel
Chair tilt and recline
Chair swivel Left and right foot pedal (both one and two dimensional foot controllers)

Head tilt

Head twist

The motion of each actuator independently controls an input to, or function of, an electronic instrument such as pitch, patch (sound) selection, filter resonance and corner frequency. These instruments include hardware and software synthesizers and sample players. This control can be accomplished by such methods including, but not limited to control voltages, MIDI controls, and over a communications protocol such as USB, FireWire, bluetooth, WiFi, Ethernet, serial, parallel, etc.

BRIEF DESCRIPTION OF THE DRAWINGS

FIG. 1 is the side view of the conceptualization of the inventions, and illustrates the direction of motion of body tilt and arm tilt.

FIG. 2 is the top view of the conceptualization of the inventions, and illustrates the direction of motion of body swivel and arm swivel.

FIG. 3 is a side view of the arm chair illustrating the joystick and thumb control.

DETAILED DESCRIPTION OF THE INVENTION

Per FIG. 1, in the present invention, a user is seated in the invention, as it is a chair, on the seat 3. Swiveling the seat 3 with respect to the base 4 actuates a control signal for controlling a musical instrument synthesizer. Tilting the body 3 or back 1, forward or backward, with respect to the base 4 actuates a separate control signal. Similarly, tilting the chair arms 2 actuate a separate control signal Referencing FIG. 2, swiveling the chair arms 5 as anchored on one end, with respect to the chair seat 6 each actuate control signals.

Referencing FIG. 3, on chair arm 7 at opposite end of arm from swivel anchor, are mounted an XY or XYZ joystick 8 and thumbwheel 9, which each actuate control signals.

Arms: Each arm is hinged to swing to the left and right (FIG. 2). This swinging is detected by a mechanism such as, but not limited to, an X-Y type joystick controller by means of a mechanical coupling including, but not limited to a pulley. This motion ultimately varies a signal that is assigned to a parameter on an electronic musical instrument. Similarly, each arm is capable of swinging up and down (FIG. 1), controlling parameters in a similar fashion.

Arm Ends: At the end of each arm is fixed a joystick type X-Y or X-Y-Z controller (FIG. 3). These are each assigned to 2 parameters, one for each direction of motion or position. Control of parameters is interfaced to the electronic musical instrument similarly to the arms above.

Additionally, mounted on the end of the arm in a convenient location, including but not limited to the body of the joystick, is a thumbwheel type controller, also controlling an independent parameter.

Body Swivel: Chair body is able to swivel in the horizontal plane, and motion or position of that swivel is detected and converted to a signal for control of the electronic musical instrument.

Body Tilt: Chair body and back are able to tilt in the vertical plane, and motion or position of that tilt is detected and converted to a signal for control of the electronic musical instrument.

Left and right foot pedal On floor or stand in front of chair operator actuates one or more foot one or two dimensional foot controllers, each actuating separate control signals Head tilt Additional sensors, in a similar fashion, convert head tilt to control signals.

Head twist Additional sensors, in a similar fashion, convert head twist to control signals.

Motion velocity and acceleration All controls may be comprised of elector-mechanical transducers including but not limited to pulley and potentiometer, accelerometer, or inclinometer. Sensor signal may be based on static position, velocity, or acceleration.

We claim:

1. Apparatus for playing music by a player comprising:

a chair for receiving the player seated on the chair;

the chair being mounted on a base allowing front to rear tilting movement of the chair and side to side swivel movement of the chair;

the chair having chair arms for receiving the arms of the seated player;

the chair arms being mounted on the chair for individual side to side movement of the chair arms and for individual up and down tilting movement of the chair arms on the chair;

each chair arm having mounted at an end thereof remote from the chair a respective one of a pair of control devices operable by the hand of the player;

the chair being responsive to each of said tilting movement of the chair, said swivel movement of the chair, said side to side movement of the chair arms, said up and down tilting movement of the chair arms and said pair of control devices to control input signals to a musical control device.

2. The apparatus according to claim 1 wherein the chair has a chair back mounted for tilting movement of the chair back relative to a chair seat and wherein the chair is responsive to said tilting movement of the chair back to control input signals to a musical control device.

3. The apparatus according to claim 1 wherein there is provided foot control devices operable by the feet of the seated player and wherein the chair is responsive the foot control devices to control input signals to a musical control device.

4. The apparatus according to claim 1 wherein the control devices comprise a joystick.

* * * * *